United States Patent [19]

Wilson, Jr.

[11] 4,073,556

[45] Feb. 14, 1978

[54] RIGID MOBILE CABINET FOR AUDIO-VISUAL AIDS

[75] Inventor: Harry Howard Wilson, Jr., Park Forest, Ill.

[73] Assignee: H. Wilson Corporation, South Holland, Ill.

[21] Appl. No.: 725,239

[22] Filed: Sept. 21, 1976

[51] Int. Cl.[2] ..... A47B 43/00

[52] U.S. Cl. ..... 312/250; 312/257 R; 312/350; 312/282

[58] Field of Search ..... 312/257 R, 250, 350

[56] References Cited

U.S. PATENT DOCUMENTS

| | | | |
|---|---|---|---|
| 498,974 | 6/1893 | Harkinson | 312/282 |
| 1,487,856 | 3/1924 | Hauserman et al. | 312/257 R |
| 2,582,812 | 1/1952 | Wise | 312/350 |
| 2,620,251 | 12/1952 | Restivo | 312/257 R |
| 2,719,633 | 10/1955 | Rosenberg | 312/257 R |
| 2,721,632 | 10/1955 | Surpierre | 312/257 R |
| 2,869,953 | 1/1959 | Miller et al. | 312/257 R |
| 3,110,536 | 11/1963 | Costantini et al. | 312/350 |
| 3,181,922 | 5/1965 | McBean | 312/350 |
| 3,272,581 | 9/1966 | Stucki | 312/257 R |
| 3,815,966 | 6/1974 | Lyman, Jr. | 312/250 |

FOREIGN PATENT DOCUMENTS

| | | | |
|---|---|---|---|
| 1,164,566 | 10/1958 | France | 312/257 R |
| 1,490,441 | 11/1969 | Germany | 312/257 R |
| 763,490 | 12/1956 | United Kingdom | 312/250 |
| 660,567 | 11/1951 | United Kingdom | 312/257 R |

*Primary Examiner*—Paul R. Gilliam
*Assistant Examiner*—Victor N. Sakran

[57] ABSTRACT

A mobile utility cabinet for audio-visual aids, adaptable to house and transport video tape, recording, projection and like materials and equipment, and for use as a learning center, said cabinet having a plurality of removable and adjustable interior and exterior shelves and components, all supported by means formed integral with the walls of the cabinet and having vertically adjustable means for selectively supporting said audio-visual aids, the said cabinet being rigidly constructed and having means in its frame cooperating with said adjustable means to resist impact and damage during transport and storage.

10 Claims, 10 Drawing Figures

Fig. 1
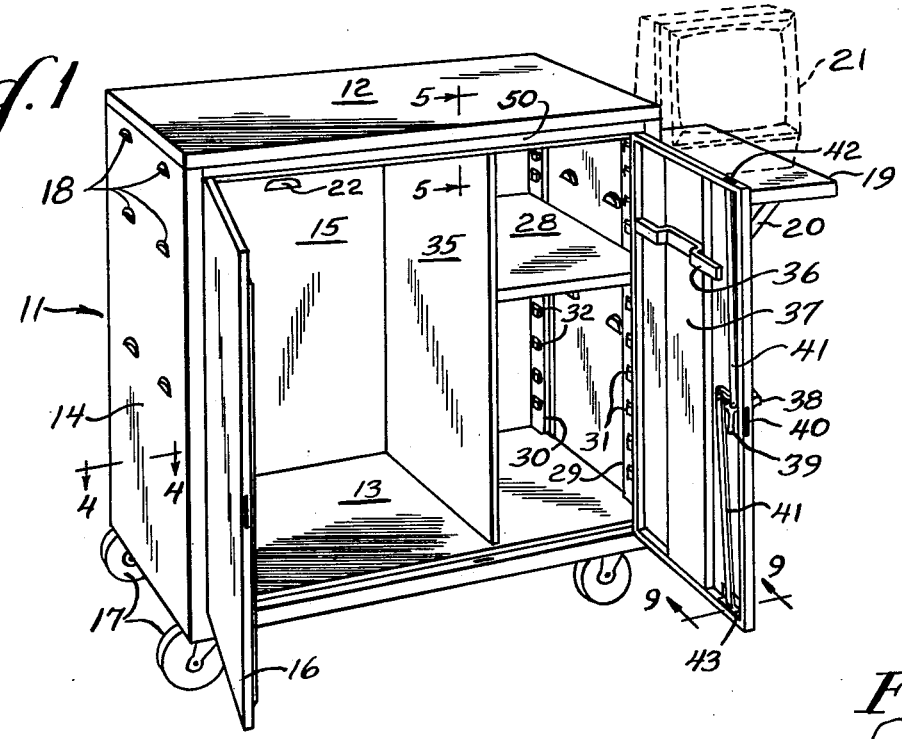
Fig. 2
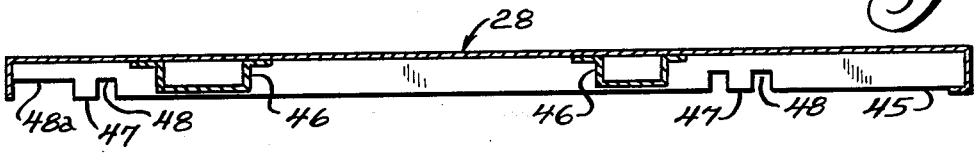
Fig. 3
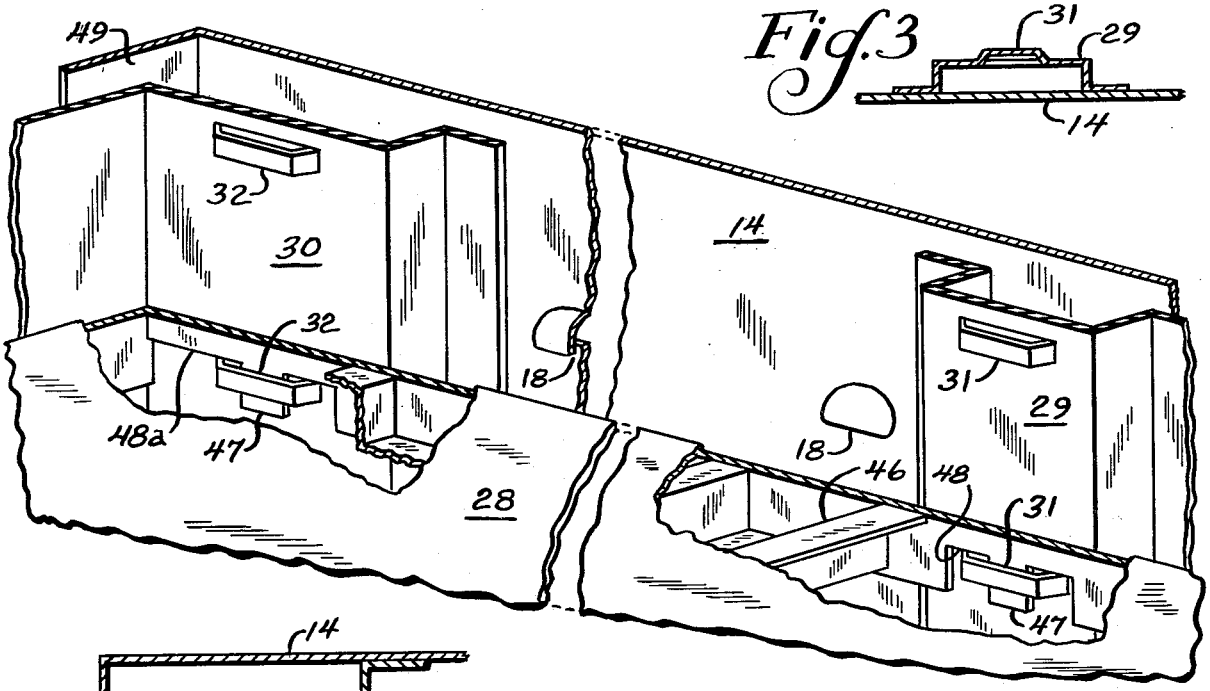
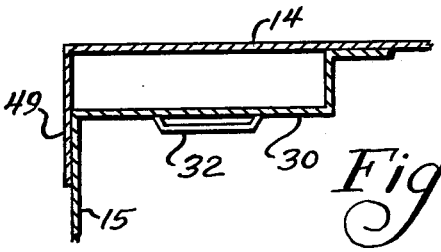
Fig. 4
Fig. 5a

RIGID MOBILE CABINET FOR AUDIO-VISUAL AIDS

Utility cabinets of the type hereby disclosed are particularly useful to support, store and transport various audio-visual aids used in modern classroom teaching situations, and are particularly useful for housing relatively expensive equipment in a fixed, yet mobile arrangement. Heretofore, such cabinets lacked structure to permit adjustment of the interior and exterior shelf arrangements to accommodate specific equipment and accessories as well as to provide means for secure, yet mobile, installation of expensive audio-visual equipment, such as videotape and educational television equipment, reading and teaching machines, projection apparatus and the like, while being sufficiently rigidly reinforced to withstand impact and damage associated with transport and storage of the cabinet, particularly when handled by unskilled personnel and students.

The present cabinet is constructed from sheet metal, such as steel, and has novel means integral with its walls for selectively mounting a number and combination of shelves and supports within the cabinet, as well as means for securely mounting drop-in apparatus on its top side, and also includes novel vertically adjustable and collapsible exterior support means for supporting audio-visual equipment, and the support means, in association with framing components of the cabinet impart rigidity to the assembled unit to resist impact during transport and storage.

OBJECTS OF THE INVENTION

It is therefore an object of the invention to provide a utility cabinet of the character referred to.

Another object is to provide a utility cabinet with novelly constructed framing members and cooperating adjustable means in the cabinet to impart rigidity to the assembled unit during transport and storage of equipment.

Another object is to provide a cabinet with novelly mounted shelves and support surfaces.

Another object is to provide a cabinet of the character described which is easy and not expensive to manufacture, simple to assemble, with versatile interior arrangements, and which is very efficient and durable in use.

BRIEF DESCRIPTION OF THE DRAWINGS

The structure by means of which the above and other objects and advantages are attained is described in the following specification, taken in conjunction with the accompanying drawings, showing a preferred illustrative embodiment of the invention, in which:

FIG. 1 is a perspective view of a cabinet embodying the invention.

FIG. 2 is a cross-sectional view of a shelf for use in the cabinet.

FIG. 3 is a cross-sectional view of the front rail for mounting the shelf shown in FIG. 2.

FIG. 4 is a cross-sectional view of the rear rail for mounting the shelf, taken on line 4 — 4 of FIG. 1.

FIG. 5*a* is a perspective view of the rails and shelf combination, parts being broken away and in section.

DESCRIPTION OF THE PREFERRED EMBODIMENT

Figure 5:
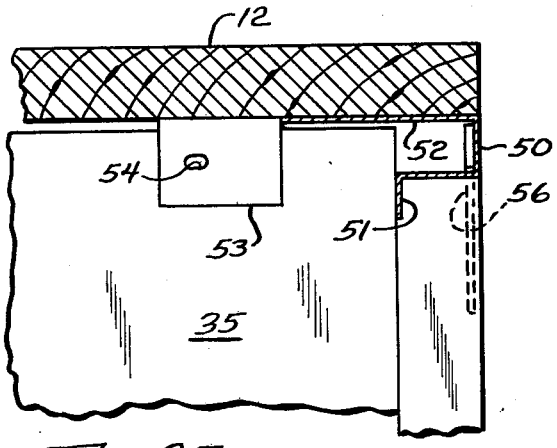
FIG. 5 is a section view of part of the top and front frame taken on line 5 — 5 of FIG. 1.

Referring particularly to FIG. 1, the cabinet 11 preferably comprises a sheet metal bottom wall 13, end walls 14 and back wall 15, with a wood or plastic laminated top 12. The open front of the cabinet is normally closed by swinging doors 16, and castors 17 are provided on the cabinet bottom. Each end walls 14 may be provided with vertically spaced apart pairs of aligned slots 18, which are selectively used to mount a shelf 19 exteriorly of the cabinet, which is hingedly connected to a mounting plate (not shown) having ears struck therefrom for selective engagement in one of the pairs of slots, and the exterior shelf may be lower or raised by means of toggle braces 20, to support a device on the shelf, such as a television set 21.

The interior of the cabinet is fitted with a pair of upstanding stringers on each end wall 14, one 29 at the front and one 30 at the rear of each wall, having spaced therealong aligned front and rear shelf support means or lugs 31 and 32, respectively. The stringers 29 and 30 are welded to their respective side walls. Louvers 22 may be formed in the rear wall 15 of the cabinet. Centrally of the cabinet is a vertically upstanding divider wall 35.

On the door 16 of the cabinet may be mounted a cord bracket 36, preferably on the reinforcing panel 37 of the door. The doors may be opened and closed and locked by means of a handle 38 connected to a cam 39 adapted to fit into a slot 40 on the other door. The cam 39 is also connected to a pair of rods 41, which are reciprocated with movement of the handle and cam for moving the rods in and out of slots 42 provided in the cabinet, and the door has reinforcing guides 43 for containing the rods.

One side of the divider wall 35 has spaced apart aligned lugs and stringer identical to the aligned stringers 29 and 30 and lugs 31 and 32, and a shelf 28 may be selectively mounted between aligned pairs of lugs. As shown in FIGS. 2–5*a*, spanning each side edge 45 of the shelf 28 are reinforcing girders 46, and the edges of the shelf also have a pair of tongues 47 formed by notches 48, the rear notch 48*a* of each edge 45 being enlarged to permit pivoting of the shelf in a vertical arc, allowing engagement of the shelf tongues in their associated stringer lugs, as shown in FIG. 5*a*. The end walls 14 have a return flange 49 which is securely welded to the rear wall 15, so that when the shelf is engaged as shown in FIG. 5*a*, the entire cabinet is tied together by the combination of the rear and end walls and shelf and supporting structure into a rigid unit, without affecting the versatile adjustment of the shelves. Where a single shelf 28 with the locking features described is used to span the end walls, the divider wall 35 may be omitted, without affecting the rigidity of the structure.

Figure 6:
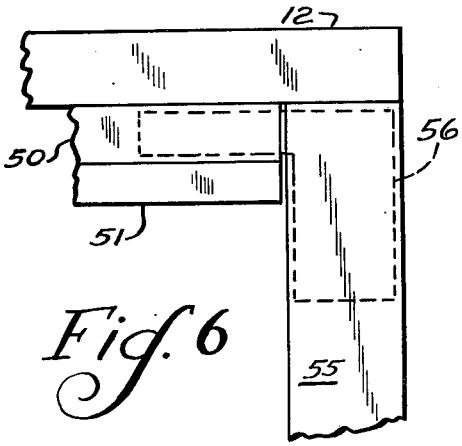
FIG. 6 is a detail elevational view of the front upper right corner of the cabinet.

With reference to FIG. 5, the top 12 is mounted on beam 50 formed across the open front of the cabinet, and at the rear and ends may be seated on return flanges formed on the rear and end walls. This beam 50 has a lower flange 51 which acts as a stop for the doors when closed, and an extended upper flange 52 for supporting the top 12. Centrally struck from the upper flange 52 may be a tab 53 for securing the divider wall 35, by means of connecting means 54, such as a nut and bolt arrangement, and the divider wall should also be secured to the rear wall 15 by conventional means, such as a vertical upstanding angular flange on the divider wall for connection with the rear wall by means of aligned apertures through the flange and rear wall with nuts and bolts connecting the same. As shown in FIG. 6, a front vertical rail 55 is provided on each end wall 14, into which is placed an angular reinforcement member 56 for securing the beam 50 to the end wall 14.

Figure 7:
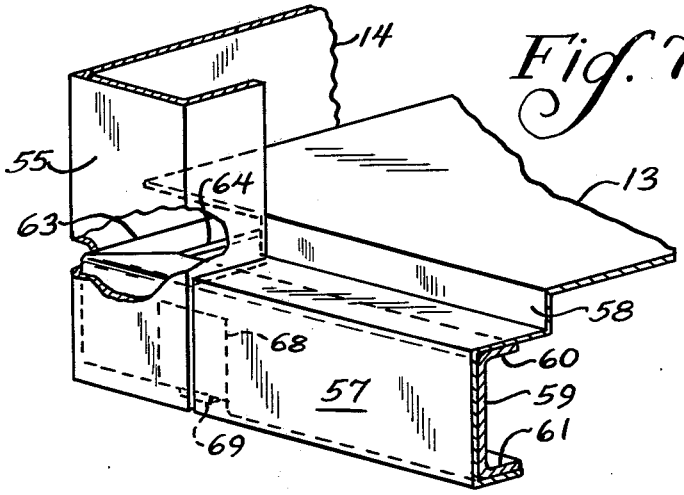
FIG. 7 is a detail perspective view of the lower left front corner of the cabinet.
Figure 9:
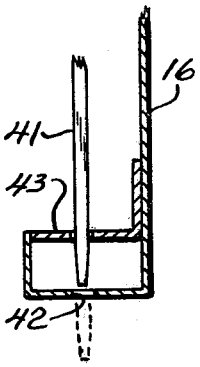
FIG. 9 is a view of the lower part of the door closing mechanism, in section, taken on line 9 — 9 of FIG. 1.
Figure 8:
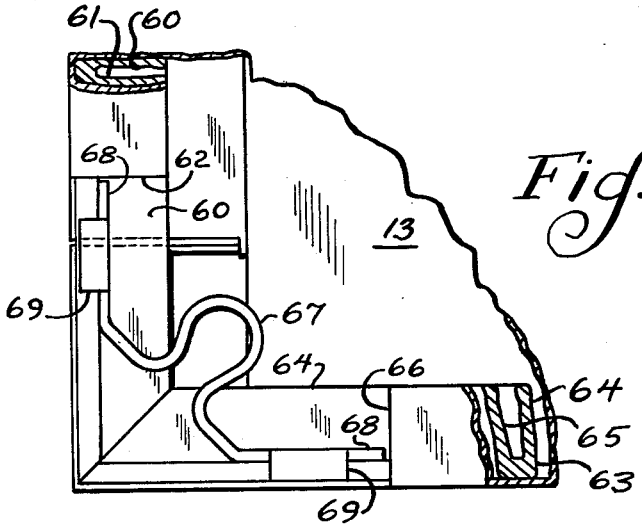
FIG. 8 is a bottom plan view of the left front corner of the cabinet, partially in section.

At the bottom of the the vertical rails 55 the floor or bottom wall 13 is secured to the end walls 14 by means of a flange 57, into which is also bent a lower stop 58 for the doors 16. Within this flange 57 and along the bottom of the end and rear walls, 14 and 15 there is secured a channel 59, having supporting legs 60 and 61, as shown in FIGS. 7 and 8. The front channel is notched, at 62, as is the side channel 63, to provide means for connecting the castor brackets 67. These bottom channels 59 and 63, with their upper and lower flanges 60 and 61 and 64 and 65, form a rigid frame for the cabinet. The castors are mounted to this rigid frame at each corner by castor brackets 67, each having extensions 68, for rigid joinder with and reinforcement of the frame, connected at frame notches 62 and 66 by means of anchors 69.

The mobile cabinet may be used to permanently mount audio-visual apparatus on the top thereof, such as a video tape recorder, or tape or player deck, and the drop shelf may be used as a top extension or for use by a teacher in sitting or standing position. The compartment within the cabinet may be used to house classroom and audio-visual materials of various sizes and shapes, and may be selectively fitted with shelves, trays, bins, drawers and the like. In this way, each cabinet is a self-contained versatile mobile learning center, capable of storing and transporting necessary equipment for a selected program, and for utilizing the equipment during teaching of selected subjects, without substantial modification of the cabinet.

Although I have described a preferred embodiment of the invention in considerable detail, it will be understood that the description thereof is intended to be illustrative, rather than restrictive, as many details of the structure may be modified or changed without departing from the spirit or scope of the invention.

I claim:

1. A mobile utility cabinet having an open front side, comprising a top wall, a back wall, a bottom wall, and spaced end walls, the latter having front and rear edges, a rigid frame connecting the lower portions of the end and back walls, said frame supporting the bottom wall, doors on the open front side of the cabinet, a top rail bridging the open front and connected at its ends to the end walls, said top rail supporting the front edge portion of said top wall, upstanding stringers one adjacent the front edge of each side wall, upstanding stringers one integral with each end of the back wall and disposed at right angles thereto to lie against the inside surface of the related side wall, all of said stringers being welded to the respective side walls, an inwardly turned flange on the rear edge of each side wall having surface contact with and being welded to the back side of the back wall, said flange and related stringer comprising a rigid post-like corner structure, and vertically spaced horizontally aligned shelf supporting means on each of said stringers.

2. The mobile utility cabinet recited in claim 1, wherein an upstanding divider wall is provided within the cabinet in parallel relation to the end walls, said divider wall having a pair of stringers and shelf-supporting means on the stringers, one of said stringers and its shelf-supporting means being aligned with the end wall stringer and its shelf-supporting means, and the other one of said stringers and its shelf-supporting means being aligned with the back wall stringer and its shelf-supporting means.

3. The mobile utility cabinet recited in claim 2 wherein a shelf is connected to the shelf-supporting means on the divider wall and end and back walls.

4. The mobile utility cabinet recited in claim 3, wherein there is a depending flange on the top rail adapted to act as a stop for said doors when the doors are brought into cabinet closed position.

5. The mobile utility cabinet recited in claim 1, in which the top rail has a depending flange adapted to act as a stop for said doors when the doors are brought into cabinet closed position.

6. The mobile utility cabinet recited in claim 1, wherein said shelf means has a pair of like tongues and notches spaced along each edge of opposed sides, and the tongues and notches are adapted to engage the shelf-supporting means.

7. The mobile utility cabinet recited in claim 1, wherein castors are secured to the frame and each castor has a castor bracket, and the castor bracket has extensions disposed angularly to said frame.

8. The mobile utility cabinet recited in claim 2, in which the top rail has a depending tab for securing the divider wall upstanding in the cabinet.

9. The mobile utility cabinet recited in claim 6, wherein the notches adapted to engage the back wall shelf-supporting means are extended to permit rocking of the shelf in a vertical arc when engaging the shelf-supporting means.

10. The mobile utility cabinet recited in claim 7, wherein the frame is notched to lock the castor brackets in position.

* * * * *